US011206879B2

(12) United States Patent
Peterson

(10) Patent No.: US 11,206,879 B2
(45) Date of Patent: Dec. 28, 2021

(54) GUARD FOR PROTECTING ONE'S NECK, AND RELATED METHODS AND SYSTEMS

(71) Applicant: Teammember Sports, LLC, Seattle, WA (US)

(72) Inventor: Eric Peterson, Seattle, WA (US)

( * ) Notice: Subject to any disclaimer, the term of this patent is extended or adjusted under 35 U.S.C. 154(b) by 0 days.

(21) Appl. No.: 15/746,938

(22) PCT Filed: Jun. 24, 2016

(86) PCT No.: PCT/US2016/039351
§ 371 (c)(1),
(2) Date: Jan. 23, 2018

(87) PCT Pub. No.: WO2017/019217
PCT Pub. Date: Feb. 2, 2017

(65) Prior Publication Data

US 2020/0077721 A1 Mar. 12, 2020

Related U.S. Application Data

(60) Provisional application No. 62/196,783, filed on Jul. 24, 2015.

(51) Int. Cl.

| | |
|---|---|
| ***A41D 13/05*** | (2006.01) |
| ***A42B 3/10*** | (2006.01) |
| *A42B 3/04* | (2006.01) |
| *A42B 3/06* | (2006.01) |

(52) U.S. Cl.
CPC ..... *A41D 13/0512* (2013.01); *A42B 3/105* (2013.01); *A42B 3/0473* (2013.01); *A42B 3/06* (2013.01)

(58) Field of Classification Search
CPC ..... A41D 13/0512; A41D 13/0531
USPC ..... 2/468, 467
See application file for complete search history.

(56) References Cited

U.S. PATENT DOCUMENTS

| | | | | |
|---|---|---|---|---|
| 3,591,863 | A * | 7/1971 | Rickard | A42B 3/0473 2/415 |
| 4,058,854 | A * | 11/1977 | Rhee | A42B 3/18 2/412 |
| 4,686,710 | A | 8/1987 | Marston | |
| 5,046,195 | A * | 9/1991 | Koritan | A41D 20/00 2/172 |
| 5,483,698 | A | 1/1996 | Douglas, Jr. | |
| 6,874,170 | B1 | 4/2005 | Aaron | |

(Continued)

*Primary Examiner* — Timothy K Trieu
(74) *Attorney, Agent, or Firm* — John M. Janeway; Janeway Patent Law, PLLC

(57) ABSTRACT

A guard to protect the neck of a person absorbs kinetic energy from an object that, if not for the guard, would strike the person's neck. The guard includes a body that has a material that deforms when an object strikes it, a shape configured to cover the posterior region of each of the cervical vertebrae of a person's spine when the guard is worn by a person to protect their neck, and a coupler to position and hold the body over the posterior region of each of the cervical vertebrae of a person's spine. The guard's body also includes a first region positioned above a person's first cervical vertebrae, when the guard is worn by a person to protect their neck, and a second region positioned above a person's last cervical vertebrae, when the guard is worn by a person to protect their neck.

3 Claims, 4 Drawing Sheets

(56) References Cited

U.S. PATENT DOCUMENTS

| | | | | |
|---|---|---|---|---|
| 8,468,613 | B2 * | 6/2013 | Harty | A42B 3/0473 2/468 |
| 8,505,113 | B2 | 8/2013 | Crye | |
| 9,243,872 | B2 * | 1/2016 | Crye | F41H 1/02 |
| D835,890 | S * | 12/2018 | Swank | D2/891 |
| 2006/0248623 | A1 * | 11/2006 | Miller | F41H 1/04 2/6.6 |
| 2010/0031409 | A1 * | 2/2010 | Norris | A42B 3/105 2/2.5 |
| 2013/0055492 | A1 | 3/2013 | Husain | |
| 2015/0067953 | A1 | 3/2015 | Chambers et al. | |

* cited by examiner

GUARD FOR PROTECTING ONE'S NECK, AND RELATED METHODS AND SYSTEMS

CROSS REFERENCE TO RELATED APPLICATION AND CLAIM OF PRIORITY

This application claims priority from the commonly owned U.S. Provisional Patent Application 62/196,783 filed 24 Jul. 2015, and titled "HELMET HEAD/NECK GUARD", and incorporated by reference.

BACKGROUND

Many sports that are fun to play can also be dangerous. For example, baseball, lacrosse, cricket and hockey are all fun to play but because they involve a ball or puck that is hard and travels fast, they can be dangerous, too. In baseball, a batter is taught to turn his back to a pitch that is high and inside, and brace for the ball's impact. Doing this though exposes the batter's neck and upper back such that when the ball hits him/her, the ball typically hits the exposed neck and/or upper back. In baseball, a player can also get hit in the neck and/or upper back while running the bases. Cricket is similar to baseball and thus there is a real possibility for the ball to hit a cricket player in the neck and/or upper back. In lacrosse, the ball may get deflected, passed toward someone or shot toward the goal and if one momentarily has his back turned to the play, the ball might strike him/her in the neck or upper back. In addition, other players might strike one with their crosse (stick) or forearm. Hockey is similar to lacrosse and thus there is a real possibility for a puck or other player's stick and/or forearm to hit a hockey player in the neck and/or upper back.

Helmets provide great protection for the players of each of these sports, but unfortunately, they only protect the players head and face, not the player's neck. This is especially true for the posterior region of a player's neck. Because the posterior region of the neck does not have much flesh and/or muscle, getting hit there by a ball, puck, stick and/or forearm can cause significant pain and damage if one or more of the neck's vertebrae are broken.

Thus, there is a need for a guard that can protect the posterior region of one's neck from damage caused by a ball, puck, stick and/or forearm hitting one's neck.

SUMMARY

In one aspect of the invention, a guard to protect one's neck absorbs kinetic energy from an object that, if not for the guard, would strike the person's neck. The guard includes a body that has a material that deforms when an object strikes it, a shape configured to cover the posterior region of each of the cervical vertebrae of a person's spine when the guard is worn by a person to protect their neck, and a coupler to position and hold the body over the posterior region of each of the cervical vertebrae of a person's spine. The guard's body also includes a first region positioned above a person's first cervical vertebrae, when the guard is worn by a person to protect their neck; and a second region positioned above a person's last cervical vertebrae, when the guard is worn by a person to protect their neck.

By configuring the guard in this manner, when a person wears the guard to protect their neck, the coupler releasably positions and holds the body over the posterior region of each of the cervical vertebrae of the person's spine. Then, when an object like a baseball or a lacrosse ball, or a cricket ball moves toward the person's neck, the object strikes the guard. The guard then absorbs some of the kinetic energy from the ball and deflects the ball away from the person's neck, before the ball can strike the person's neck and cause serious damage. For example, a batter who turns his back to a pitch that is high and inside might get hit by the ball in the posterior region of his neck or upper back. Similarly, a base runner in baseball who runs from first base to second base might get hit in the posterior region of his neck or upper back by a baseball thrown from the first base man to the second baseman. If the batter and base runner are wearing the guard, then the ball would hit guard and get deflected away from the person's neck or upper back before the seriously damaging the batter's or runner's neck or upper back.

Figure 6:
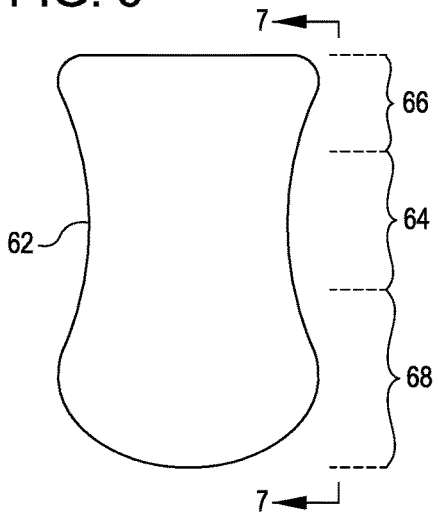
Figure 7:
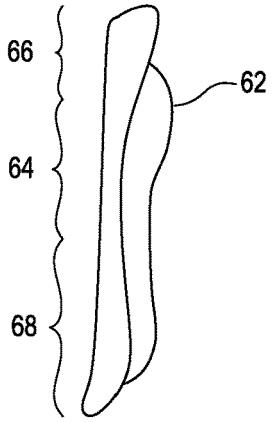

Each of FIGS. 6 and 7 shows a view of a body of a guard, according to another embodiment of the invention.

Figure 8:
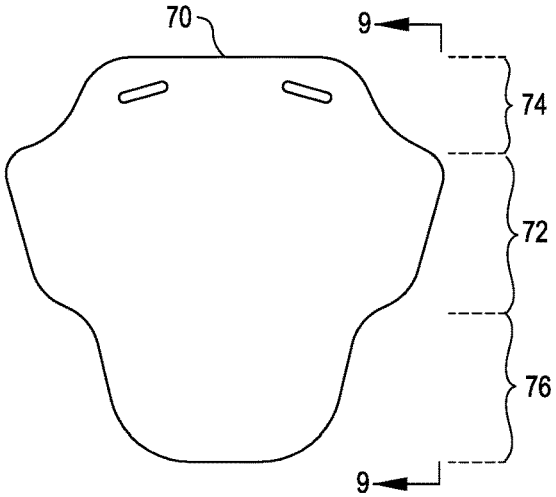
Figure 9:
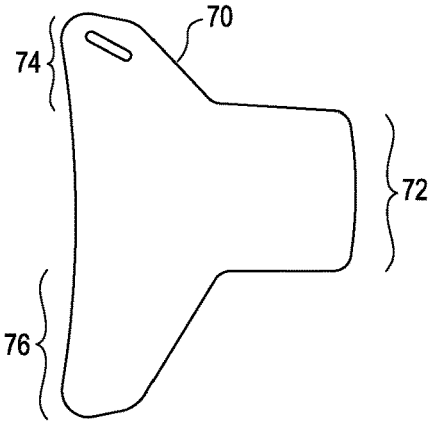

Each of FIGS. 8 and 9 shows a view of another body of a guard, according to another embodiment of the invention.

Figure 10:
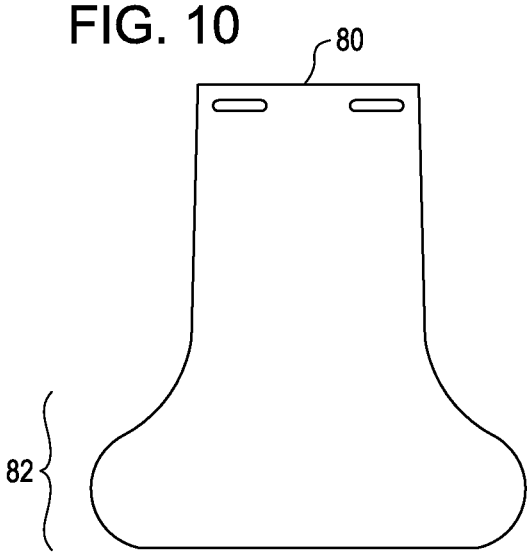

FIG. 10 shows a view of yet another body of a guard, according to another embodiment of the invention.

DETAILED DESCRIPTION

Figure 1:
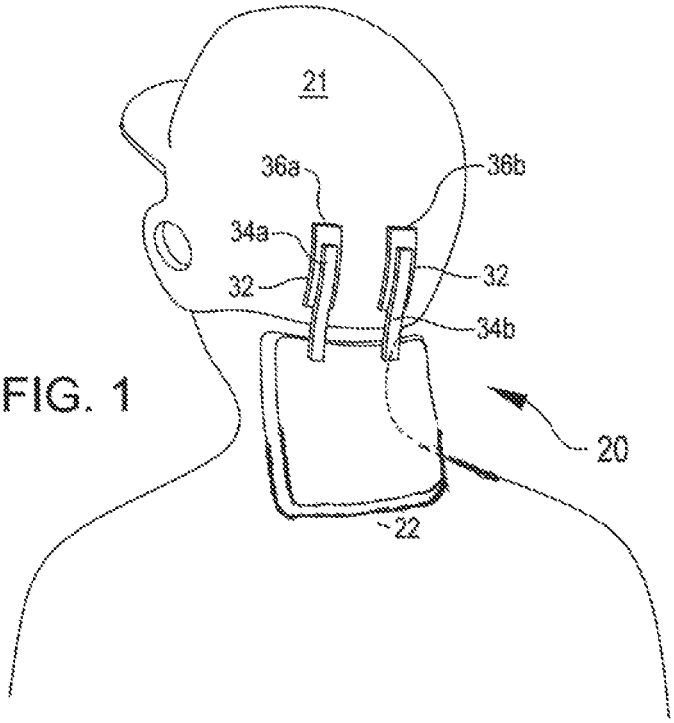
FIG. 1 shows a perspective view of a guard attached to a helmet worn by a person, according to an embodiment of the invention.
Figure 2:
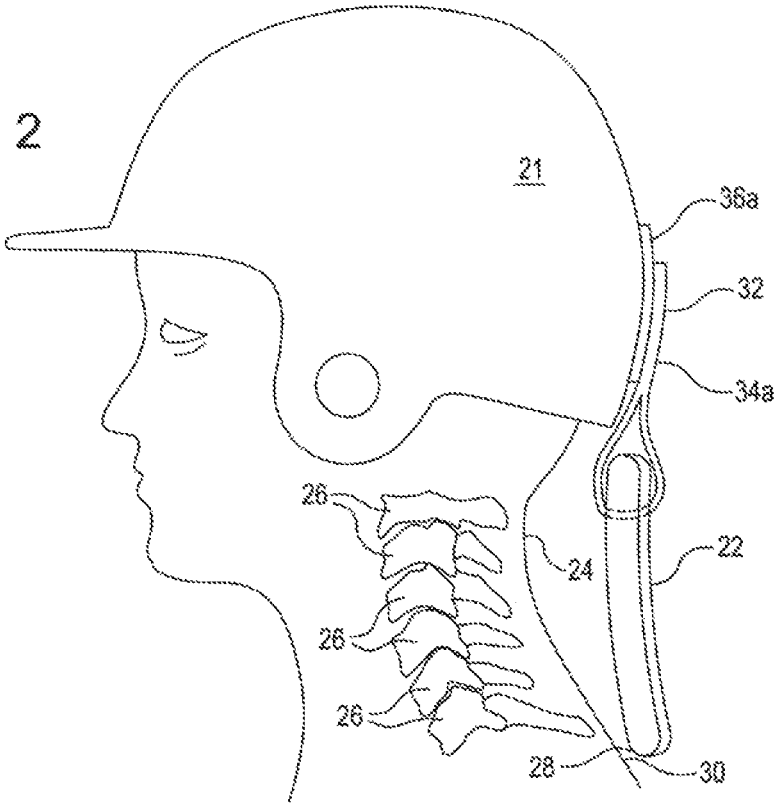
FIG. 2 shows another view of the guard and helmet shown in FIG. 1, according to an embodiment of the invention.

Each of FIGS. 1 and 2 shows a view of a guard 20 that a person may wear to protect his/her neck, according to an embodiment of the invention. The guard 20 protects the neck by absorbing kinetic energy from an object (not shown), such as a baseball, a lacrosse ball, a puck, a stick, or another person's forearm, and/or deflecting the object away from the neck before the object strikes the neck's posterior region. Although the guard 20 is show here coupled to a batting helmet 21 worn by a baseball player while batting or running bases, the guard 20 may be coupled to other types of gear that can position the guard 20 over a person's neck, such as a hat or a visor that sits around a person's head. The guard 20 may also not be coupled to other types of gear, but rather directly to a person, such as the person's neck or head.

The guard 20 includes a body 22 having a shape that is configured to cover the posterior region 24 of each of the cervical vertebrae 26 of a person's spine when the guard 20 is worn by the person to protect their neck. More specifically, the guard's body 22 hangs down over the posterior region 24 of a person's neck and forms a gap 27 between the body 20 and the posterior region 24. The body 22 also has a material that, when a moving object strikes the material, absorbs kinetic energy from the moving object without breaking or deforming to the extent that the body 22 smashes against the posterior region 24 of the neck. As discussed in greater detail in conjunction with FIG. 3, the body's material may deform elastically and/or plastically, but such deformation is not great enough to cause the body 22 to hit the posterior region 24 of the neck. Instead, when a moving object strikes the body 22, the bottom 28 of the body 22 contacts the upper-back 30 of the person wearing the guard 20, not the posterior region 24 of the person's neck. The guard 20 also includes a coupler 32 to position and hold the body 22 over the posterior region 24 of each of the cervical vertebrae 26.

By configuring the guard 20 in this manner, when a person wears the guard 20 to protect their neck, the coupler 32 positions and holds the body 22 over the posterior region 24 of each of the cervical vertebrae 26 of the person's spine. Then, when an object like a baseball or a lacrosse ball, or a cricket ball moves toward the person's neck, the object strikes the guard 20, not the neck. The guard 20 then absorbs some of the kinetic energy from the ball and deflects the ball away from the person's neck. For example, a batter who turns his back to a pitch that is high and inside might get hit by the ball in the posterior region 24 of his neck or upper-back. Similarly, a base runner in baseball who runs from first base to second base might get hit in the posterior region 24 of his neck by a baseball thrown from the first baseman to the second baseman. If the batter and base runner are wearing the guard 20, then the ball would hit guard 20 and get deflected away from the person's neck before seriously damaging his/her neck.

Still referring to FIGS. 1 and 2, the coupler 32 may be any desired mechanism capable of positioning and holding the body 22. For example, in this and other embodiments the coupler 32 includes Velcro® to releasably position and hold the body 22. More specifically, the coupler 32 includes two straps 34*a* and 34*b* that are fastened to the body 22, and two anchors 36*a* and 36*b* that are fastened to the helmet 21. The anchors 36*a* and 36*b* include the multitude of hooks that a Velcro® mechanism incorporates, and the straps 34*a* and 34*b* include the multitude of loops that a Velcro® mechanism incorporates. To couple the body 22 to the helmet 21, one pushes each of the straps 34*a* and 34*b* against a respective one of the anchors 36*a* and 36*b* so that the multitude of loops engage the multitude of hooks. To release the body 22 from the helmet 21, one pulls each of the straps 34*a* and 34*b* away from its respective anchor 36*a* and 36*b* so that the multitude of loops disengage the multitude of hooks.

Other embodiments of the coupler 32 are possible. For example, the coupler 32 may include one or more than two strap/anchor 34*a*/36*a* pairs that incorporate a Velcro® mechanism. As another example, the coupler 32 may include one or more strap/anchor pairs that incorporate a conventional snap mechanism. In such embodiments, the strap 34*a* may include the female portion of the snap, and the male portion may be fastened to the helmet 21. As yet another example, the coupler 32 may include a strap whose length is adjustable to allow the guard 20 to be worn closer or further away from the location of the strap's corresponding anchor. As yet another example, the coupler 32 may include a strap that also has the anchor. In such embodiments, the strap may be inserted through a vent hole in the helmet 21 and then fastened back onto itself. As still another example, the coupler 32 may also include a mechanism that fastens the body 22 to the lower-neck and/or the upper-back of the person to help position and hold the body 22 over the posterior region 24 of each of the cervical vertebrae 26. As still another example, the coupler may permanently, not releasably, fix the body 22 to the helmet 21.

Figure 3:
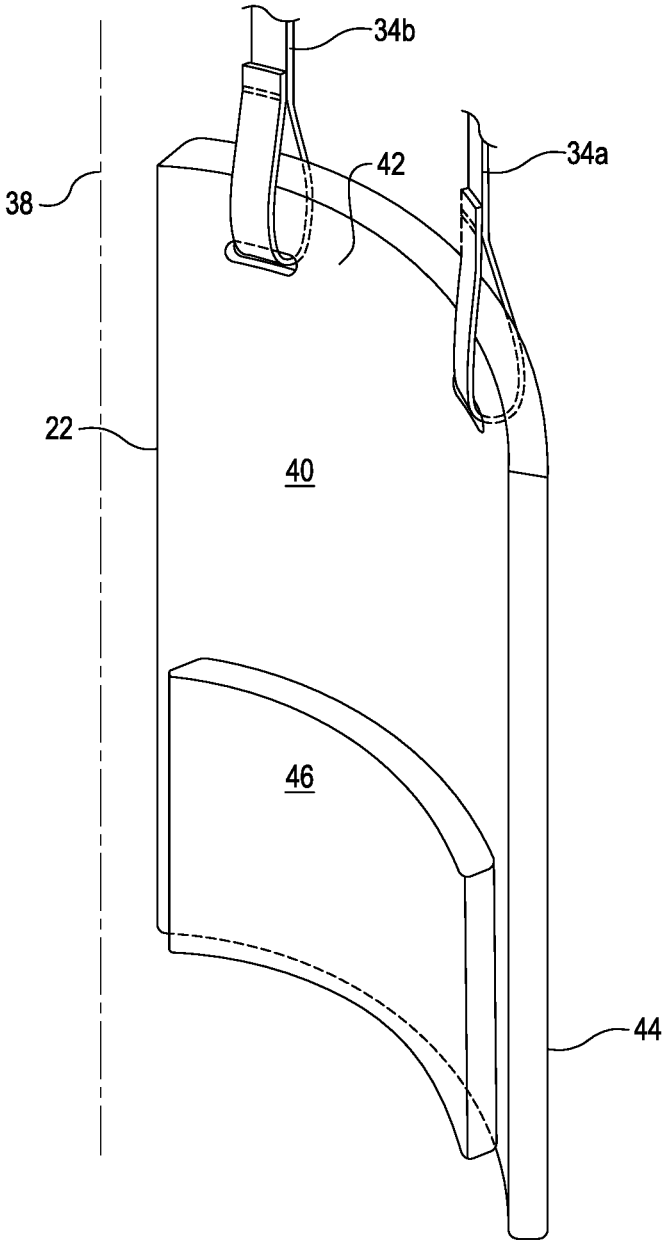
FIG. 3 shows a perspective view of the guard shown in FIGS. 1 and 2, according to an embodiment of the invention.

FIG. 3 shows a perspective view of the guard 20 shown in FIGS. 1 and 2, according to an embodiment of the invention. When a moving object hits the guard 20, the guard's body 22 absorbs some or all of the object's kinetic energy, and/or deflects the object away from the neck before the object strikes the neck's posterior region 24 (FIG. 2).

The body 22 may include any desired material capable of performing these functions. For example, in this and other embodiments the whole body 22 is 0.125 inches thick and includes a composite material having the thermoplastic polymer acrylonitrile-butadiene-styrene (ABS). With the ABS composite, the body 22 has significant impact resistance and toughness to resist breaking when an object having a significant amount of kinetic energy hits the body 22. For example, a baseball traveling 100 miles-per-hour has about 145 Joules of kinetic energy. With the ABS composite material, the body 22 may elastically deform when hit by a baseball traveling 100 miles-per-hour but should not break.

Other embodiments are possible. For example, the body 22 may include a material that plastically deforms when hit by a moving object but does not plastically deform to the extent that the body 22 hits the posterior region 24 of a person's neck.

The body 22 also includes a shape that may be configured as desired to cover the posterior region of one's cervical vertebrae 26 (FIG. 2) and help the body's material absorb kinetic energy from a moving object and/or deflect the object away from the one's neck. For example, in this and other embodiments the shape of the body 22 is rectangular—about six inches by four inches—and curved about a longitudinal axis 38 which lies about eight inches away from the inside surface 40 of the body 22. The profile of the curve is defined by a radius that extends from the axis 38 to the surface 40 and is also about eight inches long, and sweeps around the axis 38 to provide a curve-depth of about one inch. This body curvature is convex from the perspective of an object moving toward one's neck when one wears the guard 20. This convex curvature provides the body 22 strength and flexibility, and also causes most moving objects that impact the body 22 to glance off the body 22 at an oblique angle—less than 90 degrees relative to the impact surface. By directing most impacts to glance off the body 22 at an oblique angle, the amount of kinetic energy that the body 22 absorbs elastically and/or plastically from the impact may be reduced.

Other embodiments are possible. For example, three different embodiments of the body 22 each having a different shape are shown and discussed in conjunction with FIGS. 6-10.

The body 22 also includes a first region 42 and a second region 44. The first region 42 lies over one's first cervical vertebrae—the vertebrae closest to one's head—when one wears the guard 20. And the second region 44 lies over one's last cervical vertebrae—the vertebrae farthest from one's head—when one wears the guard 20. In this and other embodiments, the first and second regions 42 and 44, respectively, are similar in size and shape. In other embodiments, however, the first and second regions 42 and 44 may not be similar in size and shape. For example, as shown and discussed in conjunction with FIGS. 6-10, each of the three different embodiments of the body 22 has a first and a second region 42 and 44, respectively, that are different in size and shape.

Still referring to FIG. 3, the body 22 may also include a pad 46 to help protect one's upper-back from impacts with the bottom 28 (FIG. 2) and/or second region 44 that are caused by a moving object hitting the body 22. The pad 46 may be configured as desired to accomplish this. For example, in this and other embodiments the pad 46 includes a foam material that cushions impact between the inside surface 40 of the second region 44 and one's back. The pad 46 is about 0.5 inches thick and covers substantially all of the inside surface 40 of the second region 44. The pad 46 also includes a curve that mimics the curvature of the body 22. In other embodiments, the pad 46 may not include a curve that mimics the body's curvature, but rather include a deeper or shallower curve, or no curve at all.

Figure 4:
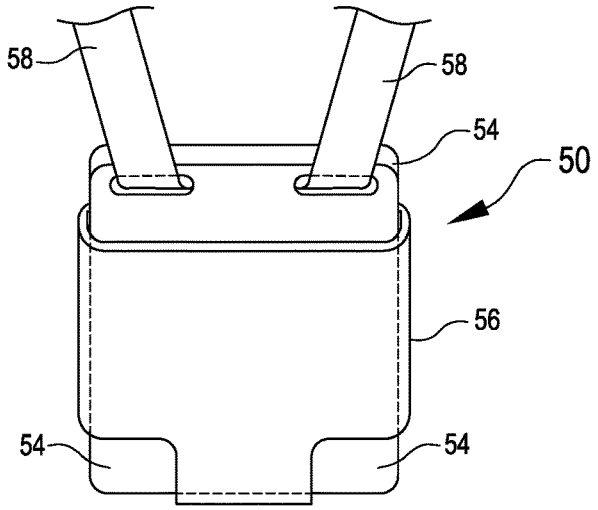
FIG. 4 shows a view of a guard, according to another embodiment of the invention.
Figure 5:
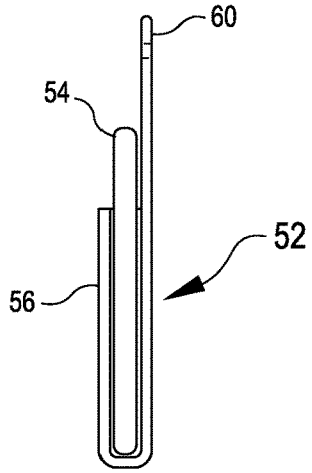
FIG. 5 shows a cross-sectional view of yet another guard, according to another embodiment of the invention.

FIG. 4 shows a view of a guard 50, according to another embodiment of the invention. And FIG. 5 shows a cross-sectional view of yet another guard 52, according to yet another embodiment of the invention. Both guards 50 and 52 include a body 54 that is similar to the body 22 (FIGS. 1-3), and a sleeve 56 to hold and help protect the body 54. The guard 50 includes a strap 58 (here two) that is fastened to the body 54 to releasably position and hold the body 54 and sleeve 56 over the posterior region of one's neck (not shown). And, the guard 52 includes a strap 60 that extends from the sleeve 56 to releasably position and hold the sleeve 56 and body 54 over the posterior region of one's neck (not shown).

The sleeve 56 may be configured as desired. For example, in this and other embodiments the sleeve 56 includes neoprene material and is sized to receive and snuggly retain the body 54. For the guard 50 shown in FIG. 4, the snug fit prevents a sudden movement of the body 54 from causing the sleeve 56 to separate from the body 54. For the guard 52 shown in FIG. 5, the snug fit prevents a sudden movement of the sleeve 56 from causing the body 54 to separate from the sleeve 56. In other embodiments, the sleeve 56 may include canvas and have a size that is substantially larger than the size of the body 54 so that the additional portion of the sleeve 56 may protect one's neck and/or shoulders from the sun's ultra-violet radiation.

Each of FIGS. 6 and 7 shows a view of a body 62 of a guard, according to another embodiment of the invention. The body 62 is similar to the body 22 (FIGS. 1-3) except the body 62 includes a third region 64 that lies between the first region 66 and the second region 68, and has a width that is shorter than the first region's width and the second region's width. In this embodiment, the shorter width of the third region 64 allows one to tuck the body 62 inside a collar or shoulder gear to help position and hold the body 62 over the posterior region of one's cervical vertebrae. The narrower third region 64 also reduces the possibility that the guard could get inadvertently knocked out of position.

Each of FIGS. 8 and 9 shows a view of another body 70 of a guard, according to another embodiment of the invention. The body 70 is similar to the body 22 (FIGS. 1-3) except the body 70 includes a third region 72 that lies between the first region 74 and the second region 76, and has a width that is longer than the first region's width and the second region's width. In this embodiment, the longer width of the third region 72 allows the body 70 to wrap farther around one's neck than the body 22 of the guard 20 does, and thus may provide additional protection for one's neck.

FIG. 10 shows a view of yet another body 80 of a guard, according to another embodiment of the invention. The body 80 is similar to the body 22 (FIGS. 1-3) except the body 80 is longer than the body 22 so that when one wears the guard that includes the body 80, the body 80 covers the posterior region of each of the cervical vertebrae and one or more thoracic vertebrae—the vertebrae that lie just below the cervical vertebrae. The body 80 also includes a second region 82 that has a width that is longer than the width of the remaining body 80, and is configured to transmit to one's trapezius muscle some or all of the kinetic energy that the body 80 absorbs from an object striking the body 80. Because the trapezius is a large muscle it is better able to absorb and safely dissipate kinetic energy without causing serious damage to one's body. Thus, by transmitting kinetic energy to one's trapezius muscle, one is better able to withstand a substantial impact from an object hitting the body 80.

The preceding discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

What is claimed is:

1. An apparatus for protecting the head and neck of a person, the apparatus comprising:

a helmet that protects the head of a person when the person wears the apparatus; and a guard that protects the neck of the person when the person wears the apparatus, the guard comprising:

a body that includes;

a material that deforms when an object strikes the material, a shape configured to cover the posterior region of each of the cervical vertebrae of a person's spine such that when the apparatus is worn by a person to protect their head and neck, the guard:

is positioned away from the person's neck to form a gap between the guard and the person's neck, wherein the gap extends over most of the person's plurality of cervical vertebrae, and remains positioned away from the person's neck while an object strikes the guard, such that the gap between the guard and the person's neck remains over most of the person's plurality of cervical vertebrae;

a first region positioned above a person's first cervical vertebrae, when the apparatus is worn by a person to protect their head and neck, the first region having a length and a width orthogonal to the length, wherein when the apparatus is worn by a person, the region's length extends along the person's spine, a second region positioned above a person's last cervical vertebrae, when the apparatus is worn by a person to protect their head and neck, the second region having a length and a width orthogonal to the length of the second region, wherein when the apparatus is worn by a person, the second region's length extends along the person's spine, and wherein the width of the body's first region is less than the width of the body's second region;

a coupler consisting of two straps, each of which couples the first region of the guard's body with the helmet, and hangs the body to cover the posterior region of each of the cervical vertebrae of the person's spine, wherein only the coupler positions and holds the body to cover the cervical vertebrae, when the apparatus is worn by a person to protect their head and neck.

2. The apparatus of claim 1 wherein the helmet is configured to protect a baseball batter's head while batting.

3. The apparatus of claim 1 wherein the helmet is configured to protect a lacrosse player's head while playing lacrosse.

* * * * *